US006942758B2

(12) United States Patent
Juppi et al.

(10) Patent No.: US 6,942,758 B2
(45) Date of Patent: Sep. 13, 2005

(54) METHOD AND EQUIPMENT FOR TAIL THREADING IN THE DRYER SECTION OF A PAPER MACHINE OR A SIMILAR MACHINE

(75) Inventors: Kari Juppi, Palokka (FI); Osmo Jääskeläinen, Säynätsalo (FI); Antti Komulainen, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 14 days.

(21) Appl. No.: 10/601,751

(22) Filed: Jun. 23, 2003

(65) Prior Publication Data

US 2004/0123964 A1 Jul. 1, 2004

(30) Foreign Application Priority Data

Jul. 1, 2002 (FI) ..... 20025033

(51) Int. Cl.[7] ..... D21F 5/00; D21F 7/00

(52) U.S. Cl. ..... 162/193; 162/194; 162/286; 226/91; 34/117; 34/120; 83/27; 83/56

(58) Field of Search ..... 162/120, 193–195, 162/206, 207, 286, 255, 260; 226/91, 92; 34/113–123, 454–458; 83/23–28, 53, 56, 614

(56) References Cited

U.S. PATENT DOCUMENTS 1,279,756 A * 9/1918 Pope ..... 162/193
4,648,942 A * 3/1987 Wanke et al. ..... 162/286
5,248,390 A * 9/1993 Fissmann et al. ..... 162/193
5,600,897 A * 2/1997 Sollinger et al. ..... 34/115
6,001,219 A * 12/1999 Caspar ..... 162/286
6,145,217 A * 11/2000 Goebel ..... 34/117
6,668,469 B2 * 12/2003 Kahl et al. ..... 34/454
2002/0053414 A1 * 5/2002 Beisswanger et al. ..... 162/272

FOREIGN PATENT DOCUMENTS

| | | |
|---|---|---|
| DE | 3707612 | 9/1988 |
| FI | 101728 | 8/1998 |
| FI | 103683 | 8/1999 |

* cited by examiner

*Primary Examiner*—Eric Hug
(74) *Attorney, Agent, or Firm*—Fildes & Outland, P.C.

(57) ABSTRACT

A method and equipment for tail threading in a paper machine in which tail threading is carried out in stages:

the web is guided to the broke treatment at a selected dryer, a cut is formed in the web to separate a narrow tail from the rest of the web, i.e. the broke web, prior to the dryer, the edge opposite to the cut of the broke web is turned away from the cutting point to form an open draw between the tail and the broke web, the tail is guided from the selected dryer to the following section while the broke web is transferred further to the broke treatment, while travelling in a controlled manner, the tail is widened to the full width and the broke web is simultaneously reduced away.

9 Claims, 2 Drawing Sheets

METHOD AND EQUIPMENT FOR TAIL THREADING IN THE DRYER SECTION OF A PAPER MACHINE OR A SIMILAR MACHINE

FIELD OF THE INVENTION

The present invention relates to a method and equipment for tail threading in the paper machine, in which tail threading is carried out in two stages as follows:

the web is guided to broke treatment at a selected dryer, a cut is formed in the web to separate a narrow tail from the rest of the web, i.e. the broke web, prior to the said dryer, the tail is guided from the selected dryer to the following section while the broke web is transferred further to the broke treatment, and while travelling in a controlled manner, the tail is widened to the full width and the broke web is simultaneously reduced away.

BACKGROUND OF THE INVENTION

In a modern paper or board machine the web transfer from the press section to the dryer section is typically carried out in a closed way without an open transfer by guiding the web at the full width until to the first dryer in the dryer section. Typically the first dryer of the dryer section is adapted to a so-called single fabric run.

The web can also be taken to the first dryer in a form of a narrow tail, which is then allowed to widen to the full width at the dryer. This is the method normally used for example in the paper machines, which have a traditional press type and an open web transfer from the press section to the dryer section. Other equipment, such as a threading blow unit or other drying unit, may be located between the press section and the first dryer. From the dryer, the web is typically allowed to travel through a doctor into a pulper located beneath the machine or to a broke conveyor or similar equipment situated below the machine.

Once the full-width web has reached the first dryer, only a narrow band of the web, a so-called tail, is first guided further to the end of the dryer section. In this system the tail is arranged to follow the fabric at least partially when travelling further in the dryer section. Once the web end has been successfully transferred to the end of the dryer section or to the end of the desired part of the dryer section, the tail is widened to the full web width so as to permit taking the full-width web through the dryer section or a desired part of it.

Unless otherwise indicated, the term 'tail threading' is used below to refer to both the initial stage of tail threading, during which only a narrow tail is taken through the dryer section or similar, and the tail widening stage, during which the narrow tail is widened to a full-width web.

The web is typically transferred further in the dryer section by means of a separate narrow initial band, i.e. the tail, which has been cut from the web edge and which is first guided further in the dryer section. The rest of the web forms another, an almost full-width band, which is to be "run down", and which is not guided to the dryer section at the initial stage, but is taken at the first dryer doctor down to a pulper located under the machine or to a broke conveyor or similar equipment located under the machine.

The appropriate detachment of the various parts of the web from the dryer both during tail threading and normal operation is slightly problematic. During the normal operation the web should detach from the dryer at its full width immediately in the gap formed after the dryer and the fabric. In the tail threading situation, on the contrary, only a narrow tail or a widening tail threading band should detach from the dryer and the rest of the web, first the main part of the web, should remain attached to the dryer surface for a determined distance even after the opening gap.

Tail threading from the first dryer onwards may therefore be particularly problematic when running at high speeds, such as speeds exceeding 1300 m/min. In such conditions, the edge nearest to the tail of the band to be taken down easily tends to follow the fabric further in the dryer section, since the action directed to the tail also affects this edge and vice versa. For example, it has been noticed that in certain cases the edges tend to drift on top of each other after the cutting point, which then tears the tail edge at the final stage of the widening operation.

To be able to carry out tail threading from the first dryer onwards using the tail, it must be prevented that the aforementioned second band, i.e. the main part of the web, starts to follow the web too early causing thus problems in the dryer section, such as excessive broke accumulation in the dryer section basement. Therefore, the main part of the web must be kept attached to the first dryer surface in a controlled way during tail threading even in the gap formed by the dryer and the fabric.

The web travelling from the press section easily detaches from the first dryer surface, because the web cannot have been attached to it properly, utilizing e.g. a nip, such as takes place in the press section, where the web is attached to the surface of a smooth roll by means of a nip. If the web were too strongly attached to the dryer surface, it would result in web detachment problems at the stage when it is finally desired to detach the web from the dryer.

Efficient high-vacuum blow/suction boxes have been developed for dryer sections. These boxes can be used to make the web controllably follow the dryer fabric during normal operation after the opening gap of the dryer and fabric, even when running at high speeds. By using these boxes it can be ensured that the actual narrow tail and the web part widening at the widening stage reliably follow the dryer fabric. Breaks must not be produced in either the tail or the widening web and therefore the web transfer must take place in a controlled way. Because a very high vacuum is applied in these vacuum boxes, the web part to be run down may tend to follow the fabric in the tail threading stage instead of controllably following the first dryer and dropping down to the pulper or similar under the machine only at the dryer doctor.

International patent applications WO 98/3397 and WO 02/35001 propose some solutions for the aforementioned problems. The former publication makes known equipment, which uses two water cutters to cut a tail at the center of the web. At least one of the cutters is moved to the web from outside to ensure that the band remaining at the edge is sharp-edged and the tail is produced without an excess tail end. This, however, does not resolve the problems at the widening stage.

The latter publication is even more closely related to the present invention. It discusses the aforementioned problem of arranging an appropriate detachment of the various web parts at each stage. It is attempted to prevent the edge nearest to the tail from following along by providing adjustable suction in the cross-machine direction on the outlet side of the dryer. The transfer zone of the vacuum box suction is synchronized with the spreader slide movement. In addition, a narrow intermediate band is formed between the actual tail and the web part running to the pulper. The intermediate band may be simply a wider cut produced with high pressure and a large amount of water. These solutions have disadvantages. A third band, leaving in an unspecific way, can after all cause problems later in the machine. A cut made applying a higher pressure wets and soils the fabric more than usually.

SUMMARY OF THE INVENTION

The object of the present invention is to provide an improved method and equipment for tail threading in a paper machine or a similar machine.

Another object of the invention is to provide a method and equipment in which the aforementioned problems have been minimized.

More particularly, an object is to provide a method and equipment, which can be used to ensure a controlled tail travel through the dryer section.

A further object is to provide a method and equipment, which can be used to prevent the web part to be taken down from travelling uncontrollably further in the dryer section.

Still another object is to provide a method and equipment which can be used to controllably separate the tail and the band to be taken down and make them travel in a controlled way at and also after the gap opening at the first dryer. In addition, it is attempted to reduce the water pressure applied in the cutting operation to decrease the fabric load.

Accordingly, a method for tail threading in a paper machine or a similar, in which tail threading is carried out in stages:

- the web is guided to the broke treatment at a selected dryer,
- a cut is formed in the web to separate a narrow tail from the rest of the web, i.e. the broke web, before the said dryer,
- the tail is guided from the selected dryer to the following section while the broke web is transferred further to the broke treatment,
- while travelling in a controlled manner, the tail is widened to the full width and the broke web is simultaneously reduced away, is characterized in that at least during the widening operation, preferably also prior to the widening operation, the edge opposite to the cut of the broke web is turned away from the cutting point in order to form an open draw between the tail and the broke web.

Still further, a device for tail threading in the paper machine dryer section comprising of

- a cutter, which cuts at least one tail from the full-width web prior to the selected dryer while the remaining part forms the broke web,
- elements for guiding the tail forward from the selected dryer,
- elements for removing the broke web from the selected dryer, typically to a pulper located underneath,
- elements for widening the tail to a full-width web, is characterized in that the cutter includes blow equipment located after the cutter in the web travel direction for turning the broke web edge away from the cutting point and for forming an open draw between the tail and the broke web.

The invention can be very favorably applied in a cylinder dryer section, in which at least the first cylinder dryer group is a so-called single fabric run adapted group, in which there is, in addition to a water cutting nozzle, tail squirt blow equipment prior to the first dryer, in the straight section of the dryer fabric for turning the web directed to broke and for forming an open draw. The web turning also means that the edge of the part directed to broke may become folded. The invention can be applied in other parts of the paper machine, too, especially after the dryer section, particularly at its end in tail threading to a finishing machine. The invention can also be used when the web is taken from the press to the dryer section with a so-called open transfer. The aim is to stop a break occurring in the dryer section at the 1st dryer and to start tail threading.

These and other features and advantages of the invention will be more fully understood from the following detailed description of the invention taken together with the accompanying drawings.

DETAILED DESCRIPTION OF THE INVENTION

Figure 1:
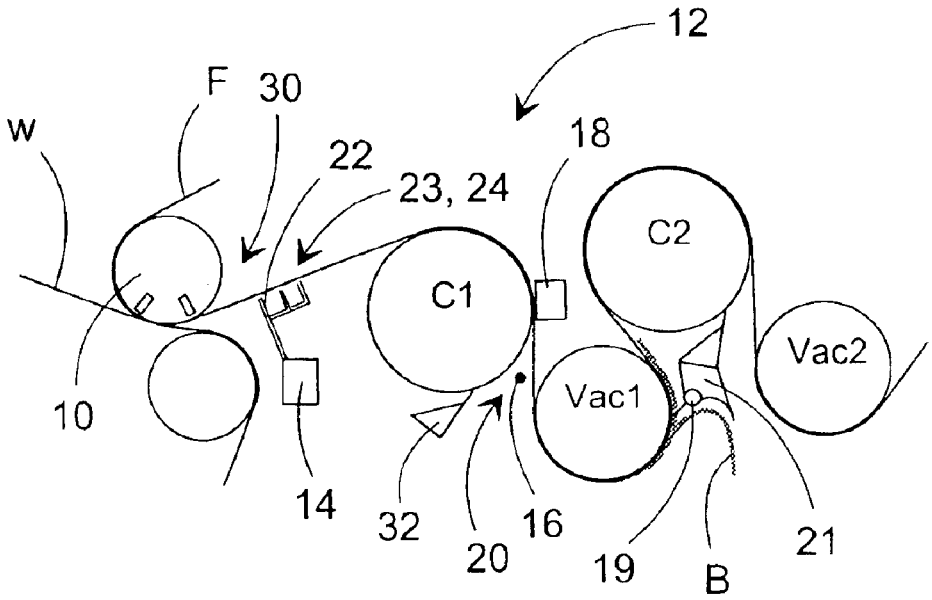
FIG. 1 is a schematic side view of the first dryer group of a paper machine.

FIG. 1 shows the initial part of the first dryer group in a dryer section equipped with a single fabric run. The invention can be applied in other parts of the dryer group as well, in fact also in other parts of the paper machine (forming section, press section, dryer section, afterdryer section or coating section).

In the case of FIG. 1 the web to be dried w is transferred by means of a transfer suction roll 10 to the dryer fabric F of the dryer group 12. The dryer fabric F guides the web over the first dryer C1 and further through the first suction roll Vac1 to the following dryer C2 and so forth alternately over a dryer and a suction roll to the end of the dryer group.

Instead of suction rolls, other components, known as such, can be used in the dryer group to guide the web travelling with the fabric support at the intervals between the dryers and the suction rolls.

A vacuum box 18 is adapted in the pocket formed by the dryers C1 and C2 and the suction roll 16 to guide the web to be dried to the suction roll 16 during the operation in a manner known as such in the gap 20 opening between the first dryer Cl and the dryer fabric F so that it controllably follows the dryer fabric.

After a machine shutdown or a web break the new web is brought to the dryer F at its full width by means of the transfer suction roll 10. The dryer F guides the full-width web over the first dryer C1 to the doctor 32, which drops it down to the pulper. The suction box 18 is not in operation at that time or its suction pressure is small.

The cutting device 22, installed in a cross-directional slide, cuts a narrow tail from the web. The dryer fabric F is allowed to first take this narrow tail from the opening gap 20 forward in the dryer section. To detach the tail from the dryer C1, in a deeply opening gap (opening less than 40 mm) there is provided a blow device 16, consisting of a pipe whose width equals to that of the tail and which is provided with 1 mm bores with 20 mm's distribution.

Should another part of the web, i.e. the broke web, however, start to follow the tail, it is peeled off on the other side of the suction roll Vac1 with the blow equipment 19 and appropriate guides 21.

The cutting device 22 forming the tail can be any device suitable for cutting. In this example it is a water cutter. In the case of FIG. 1 cutting takes place after the transfer suction roll in the straight section of the dryer fabric F. Cutting can also be arranged to take place earlier, i.e. prior to the transfer suction roll. However, it is essential that after the cutting, most preferably in the straight section of the dryer fabric, there is the first blow equipment 23, 24, whose operation and design will be discussed in greater detail hereinafter. Most advantageously these are mounted in the same slide 14 as the cutting device, because their cross-directional movement must synchronize with it.

Figure 2:
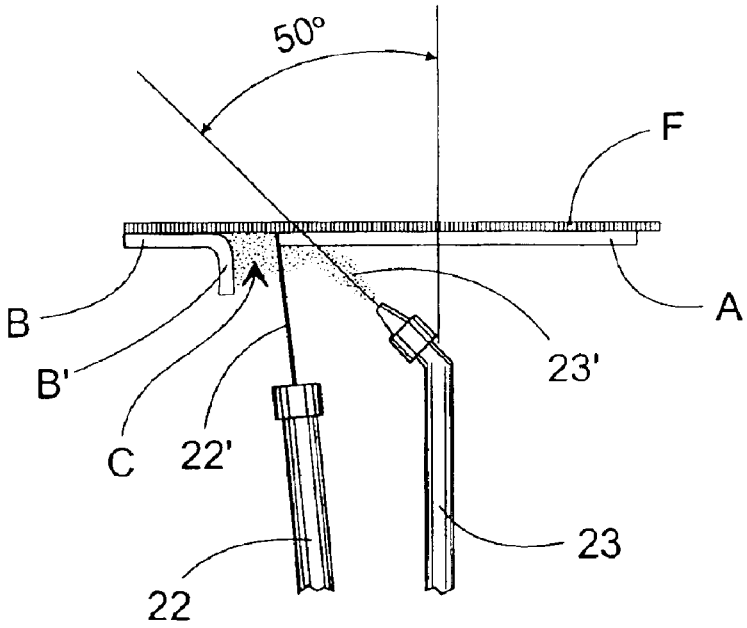
FIG. 2 shows the cutting operation in tail threading seen from the fabric direction.
Figure 3:
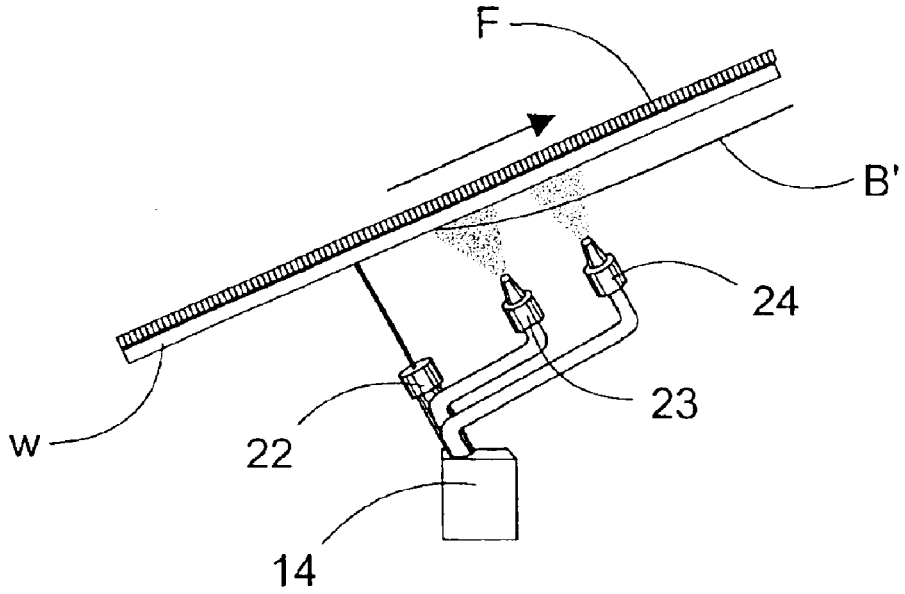
FIG. 3 is a lateral view of the cutting operation of FIG. 2.

In FIG. 2 the water jet 22' produced by the cutting device 22 cuts a narrow tail A from the web w which is travelling against the dryer fabric F while the rest of the web forms the broke web B. The blow nozzle 23, shown in the figure, provides a blow 23', which turns the edge B' of the broke web B away from the cutting point. The edge may also become folded, but the most important is that an open draw C is created at the cutting point.

According to FIG. 2 the first blow equipment comprises of compressed air nozzles 23 and 24. The first of these is placed in a more vertical position than the second. The first one is usually at an angle of 30 to 70 degrees (55 degrees in FIG. 2) and the second 55 to 85 degrees with respect to the perpendicular of the web (w). Thanks to the edge-turning blow the water pressure of the cutting device can be decreased, which gives evident advantages. In addition to more successful tail threading compared to previous machines, moistening and soiling of the dryer fabric is also reduced.

Figure 4:
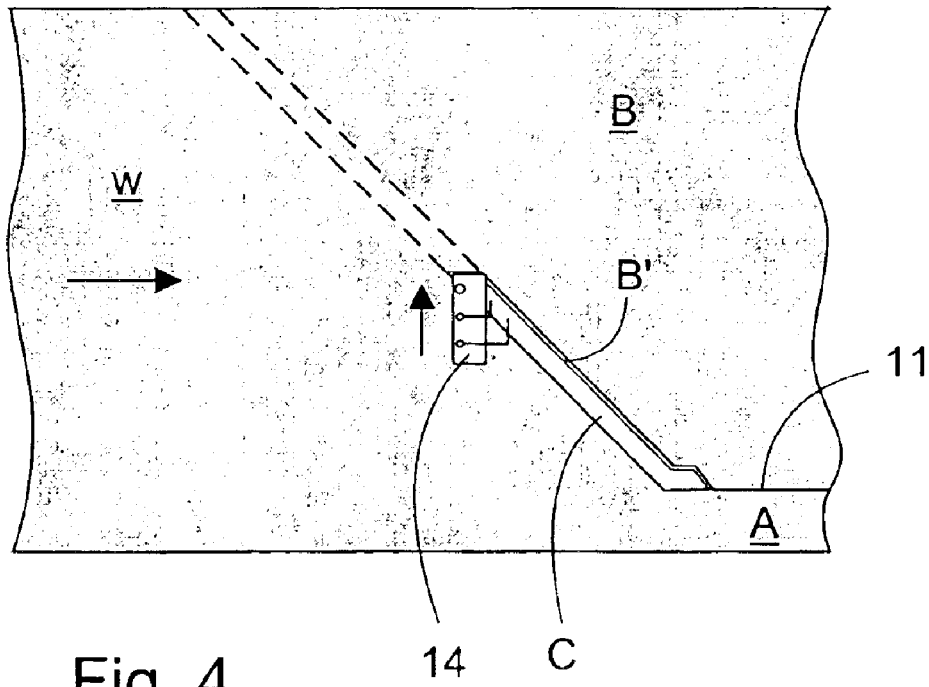
FIG. 4 illustrates the tail widening stage seen from above.

FIG. 4 illustrates the tail widening stage, during which the narrow tail A is widened to a full-width web, and the broke web is simultaneously reduced away. In the figure the widening operation is in the mid-way with the slide 14 travelling across the web. The original cut 11, shown in the drawing, divides the full-width web w into a tail A and a broke web B. Before the widening operation the first blow equipment has been switched on thus creating an open draw C. As the widening proceeds, this follows the widening. The edge B' of the broke web can no more disturb the widening operation by tearing a break in the outspread tail.

In another embodiment the broke web is destroyed in order to improve the reliability of the tail threading. The broke web is cut into many pieces by several water and/or air jets. Small pressure is here enough because the cut quality isn't an issue. The nozzles are mounted each into own slide and these slides and main slide 14 are linked into a chain. If flexible (rubber) ropes were used between slides, the slides would move with equal distance between. Preferably after water jet (which does not cut the web fully) there are air jets tearing up the slices. Now the slices don't "want" to follow VAC 1 roll.

In principle, the invention can be applied with the initially mentioned zone-controlled suction box, although its need is not likely. A second and third set of blow equipment 16 and 19 also improve the reliability of tail threading.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method for tail threading a web in a paper machine or a similar, in which tail threading is carried out in stages:

guiding the web to a broke treatment at a selected dryer of a dryer section, before the said dryer, cutting the web into a tail portion and a broke web portion, the broke web portion having an edge alongside the cut, guiding the from the selected dryer to the following section while the broke web portion is transferred further to the broke treatment, whereby while travelling through the dryer section, the tail portion is widened to a full web width and the broke web portion is simultaneously reduced away, the method characterized in that during the tail threading operation, the edge of the broke web portion is turned away from the web in order to form an open draw between the tail portion and the broke web portion.

2. A method as set forth in claim 1, characterized in that turning of the said edge is carried out by means of a blow after cutting.

3. A device for tail threading a web in a selected dryer of a dryer section of a paper machine, the dryer section comprising:

a cutter device including a cutter adapted to cut a full-width web into a tail portion and a broke web portion prior to the selected dryer, the broke web portion including an edge beside the tail portion, elements for guiding the tail portion forward from the selected dryer, elements for removing the broke web portion from the selected dryer, elements for widening the tail to a full-width web, characterized in that the cutter device includes blow equipment located after the cutter in the web travel direction for turning the edge of broke web away from the web and for forming an open draw between the tail portion and the broke web portion.

4. A device as set forth in claim 3, characterized in that the blow equipment comprises a first compressed air nozzle, which is set in an angle of 30–70 degrees with respect to the web perpendicular.

5. A device as set forth in claim 4, characterized in that the blow equipment includes a second compressed air nozzle, which has been set at an angle of 55–85 degrees in the web travel direction after the first nozzle.

6. A device as set forth in claim 3, characterized in that the selected dryer is provided with a suction box, adjustable in the cross-machine direction, on the side of an opening gap of the selected dryer.

7. A device as set forth in claim 3, characterized in that the selected dryer is provided with second blow equipment in an opening gap of the selected dryer for detaching the tail from the dryer to the fabric.

8. A device as set forth in claim 3, characterized in that after the selected dryer there is provided a third set of blow equipment in connection with the web for peeling the broke web off the web, should it start to follow the tail.

9. A device as set forth in claim 3, characterized in that the blow equipment is located in a straight section of the web.

* * * * *